US008085945B2

(12) United States Patent
Su et al.

(10) Patent No.: US 8,085,945 B2
(45) Date of Patent: Dec. 27, 2011

(54) COMMUNICATION MACHINE ROOM WIDEBAND NOISE SUPPRESSION SYSTEM

(75) Inventors: Fu-Cheng Su, Sinjhuang (TW); Yuan-Liang Liao, Sinjhuang (TW); Jyh-Ren Lee, Sinjhuang (TW); Yi-Hong Liao, Sinjhuang (TW)

(73) Assignee: Asia Vital Components Co., Ltd., Taipei County (TW)

( * ) Notice: Subject to any disclaimer, the term of this patent is extended or adjusted under 35 U.S.C. 154(b) by 918 days.

(21) Appl. No.: 12/148,720

(22) Filed: Apr. 22, 2008

(65) Prior Publication Data

US 2009/0180636 A1 Jul. 16, 2009

(30) Foreign Application Priority Data

Jan. 15, 2008 (TW) ..... 97101436 A

(51) Int. Cl.
*G10K 11/16* (2006.01)

(52) U.S. Cl. ..... 381/71.3; 381/71.1; 381/71.14; 381/93; 381/94.1; 381/94.9; 379/390.04; 379/391; 379/392; 379/406.01; 379/406.05

(58) Field of Classification Search ..... 336/71.3, 336/71.4, 71.14, 92, 93, 95, 71.1, 94.1, 94.7, 336/94.9; 379/390.04, 391, 392, 392.01, 379/406.01, 406.05, 406.06
See application file for complete search history.

(56) References Cited

U.S. PATENT DOCUMENTS

| | | | | |
|---|---|---|---|---|
| 4,508,486 | A | 4/1985 | Tinker | 415/119 |
| 5,393,199 | A | 2/1995 | Alizadeh | 416/189 |
| 5,583,943 | A * | 12/1996 | Ohashi et al. | 381/71.5 |
| 5,617,479 | A * | 4/1997 | Hildebrand et al. | 381/71.3 |
| 5,740,256 | A * | 4/1998 | Castello Da Costa et al. | 381/94.7 |
| 5,790,673 | A * | 8/1998 | Gossman | 381/71.1 |
| 5,844,996 | A * | 12/1998 | Enzmann et al. | 381/71.6 |
| 5,995,632 | A * | 11/1999 | Okada | 381/71.3 |
| 6,049,615 | A * | 4/2000 | Chou et al. | 381/71.3 |
| 6,483,926 | B1 * | 11/2002 | Yamashita et al. | 381/71.7 |
| 6,738,482 | B1 * | 5/2004 | Jaber | 381/94.7 |
| 6,839,439 | B2 * | 1/2005 | Daly | 381/71.5 |
| 6,931,123 | B1 * | 8/2005 | Hughes | 379/406.01 |
| 7,181,027 | B1 * | 2/2007 | Shaffer et al. | 381/94.1 |
| 7,206,404 | B2 * | 4/2007 | Parry et al. | 379/406.01 |
| 7,279,964 | B2 * | 10/2007 | Bolz et al. | 330/10 |
| 7,539,459 | B2 * | 5/2009 | Steer | 455/67.11 |
| 7,706,525 | B2 * | 4/2010 | King | 379/392 |
| 7,706,546 | B2 * | 4/2010 | Delchar et al. | 381/71.1 |
| 7,760,888 | B2 * | 7/2010 | Kanamori et al. | 381/83 |
| 7,809,129 | B2 * | 10/2010 | Wu et al. | 379/406.01 |
| 7,869,607 | B2 * | 1/2011 | Barath et al. | 381/71.3 |
| 2007/0297619 | A1 * | 12/2007 | Pan | 381/71.11 |
| 2008/0192955 | A1 * | 8/2008 | Merks | 381/92 |
| 2008/0317259 | A1 * | 12/2008 | Zhang et al. | 381/92 |

* cited by examiner

*Primary Examiner* — Anh Mai
*Assistant Examiner* — Joselito Baisa

(57) ABSTRACT

In a communication machine room wideband noise suppression system, a sensing unit detects a noise source produced by a fan during the operation thereof and generates a noise input signal and a feedback signal, which are sent to a signal amplifying unit for signal amplification. The amplified signals are then sent to a signal converting unit and converted into digital signals. A multi-channel hybrid controller receives the digital signals and makes corrections and conduct rapid convergence algorithm to derive a reverse digital signal, which is sent to the signal converting unit and converted into a reverse analog signal. The reverse analog signal is sent to the signal amplifying unit for power amplification to generate a control signal for driving a loudspeaker unit to produce interfering acoustic wave, so as to cancel out the noise source and achieve the purpose of eliminating wideband noise.

4 Claims, 3 Drawing Sheets

COMMUNICATION MACHINE ROOM WIDEBAND NOISE SUPPRESSION SYSTEM

FIELD OF THE INVENTION

The present invention relates to a wideband noise suppression system, and more particularly to a wideband noise suppression system applied in a communication machine room to eliminate fan noise through a digital signal microprocessor, a sensing unit, and a loudspeaker unit.

BACKGROUND OF THE INVENTION

With the constantly developed communication technologies, communication service providers have established many communication machine rooms in urban areas to optimize communication service quality by improving the problems of jammed communication lines, poor signal receiving quality, unstable signal, etc. On the other hand, the communication machine room itself is an important factor in maintaining stable signal quality. Therefore, the communication machine room requires manual maintenance from time to time. People working in the communication machine room must withstand the noises produced in the room by cooling fans provided on the wideband network mainframes or server workstations.

The problem of fan noise has received high attention of the communication service providers, because the noise tends to cause different degrees of discomfort and anxiety to people, make people feel tired easily to reduce work efficiency and suffer from mental and physiological detriment. Conventionally, the noises are only passively suppressed by using sound absorption wool and/or sound insulating boards in the communication machine room or having operators to wear earmuffs to isolate the noises. However, the sound absorption wool, the sound insulating boards, and the earmuffs are only effective in isolating high-frequency noises but not low-frequency noises.

In brief, the conventional ways for passively suppressing the noises in the communication machine room have the following disadvantages:

1. The sound absorption or sound transmission of the building structure and materials has close relation with the noise frequency. Generally speaking, sound absorption materials have effective sound canceling performance for high-frequency noises ranging from 1 KHz to 20 KHz, but are less effective for low-frequency noises lower than 1 KHz.
2. The use of sound absorption wool and sound isolation boards in the communication machine room would only unnecessarily waste the usable space in the room without substantial benefit in suppressing the noises.

It is therefore desirable to overcome the problems and disadvantages in the conventional passive noise suppression in communication machine room.

SUMMARY OF THE INVENTION

A primary object of the present invention is to provide a communication machine room wideband noise suppression system, with which a sensing unit detects a noise source produced by a fan during the operation thereof and generates a noise input signal and a feedback signal, which are sent to a signal amplifying unit for signal amplification. The amplified signals are then sent to a signal converting unit and converted into digital signals. A multi-channel hybrid controller receives the digital signals and makes corrections based on the received signals, and conducts rapid convergence algorithm to derive a reverse digital signal, which is sent to the signal converting unit and converted into a reverse analog signal. The reverse analog signal is sent to the signal amplifying unit for power amplification to generate a control signal for driving a loudspeaker unit to produce interfering acoustic wave, so as to cancel out the noise source and achieve the purpose of eliminating wideband noise.

According to a preferred embodiment of the present invention, the signal amplifying unit consists of a pre-amplifier and a power amplifier. When a fan in the communication machine room produces noise during the operation thereof, the sensing unit generates a noise input signal and a feedback signal, which are sent to the pre-amplifier for signal amplification and then sent to an analog to digital converter and converted to the digital signals. The digital signals are sent to the multi-channel hybrid controller, so that the multi-channel hybrid controller makes corrections based on the received digital signals and conducts rapid convergence algorithm to derive a reverse digital signal. The reverse digital signal is sent to a digital to analog converter and converted into a reverse analog signal, which is sent to the power amplifier for power amplification to generate a control signal for driving the loudspeaker unit to produce an acoustic wave that has a level the same as that of the noise source but a phase reverse to that of the noise source, so that the wideband noise produced by the fan is cancelled out by the acoustic wave produced by the loudspeaker unit.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

A communication machine room wideband noise suppression system according to a preferred embodiment of the present invention is a standalone system, which employs multi-channel active noise control (ANC) to process low-frequency fan noise and effectively reduce the fan noise without the need of being aided with a personal computer, and is therefore cost-effective.

Figure 1:
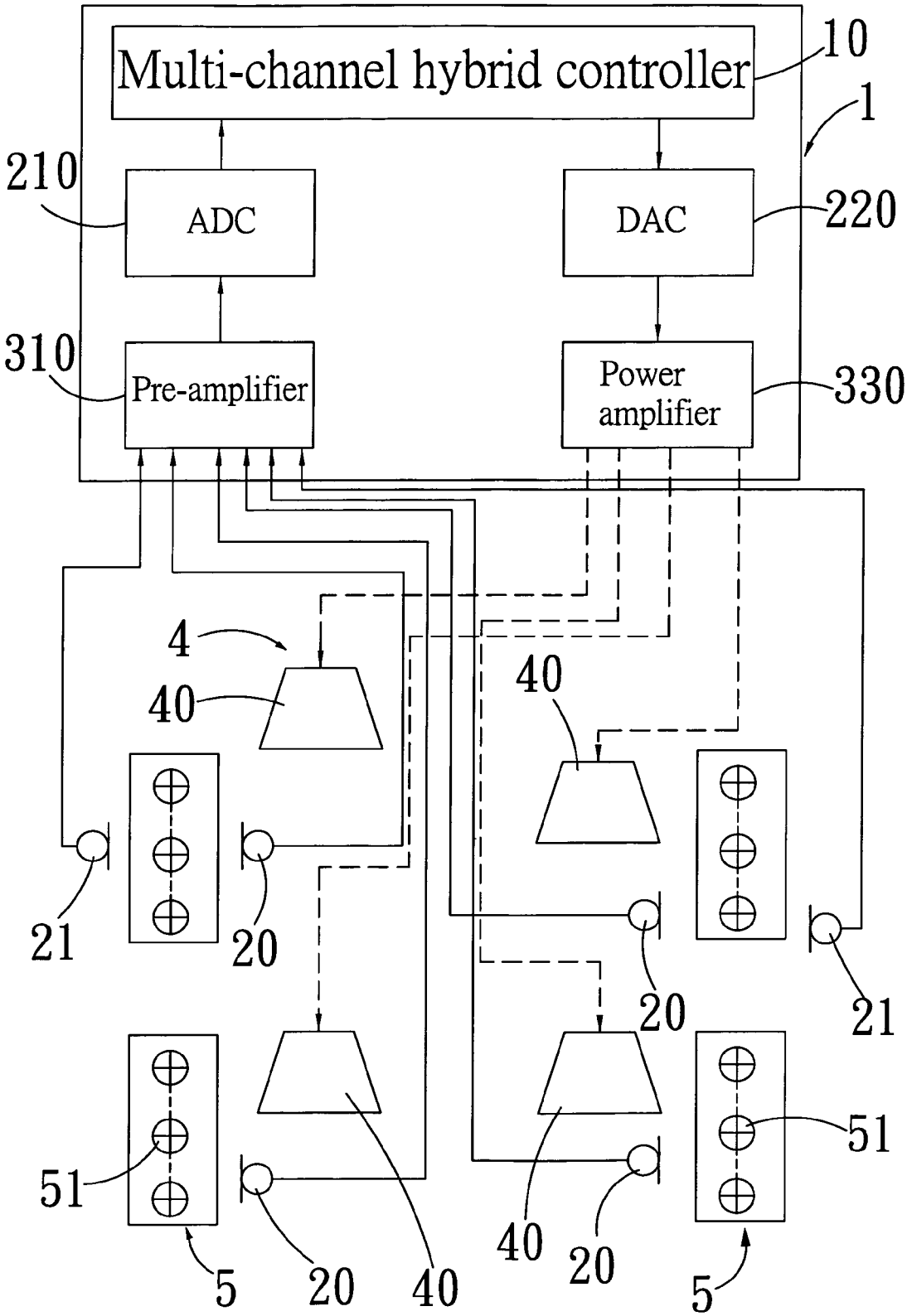
FIG. 1 is a system diagram of the present invention.
Figure 2:
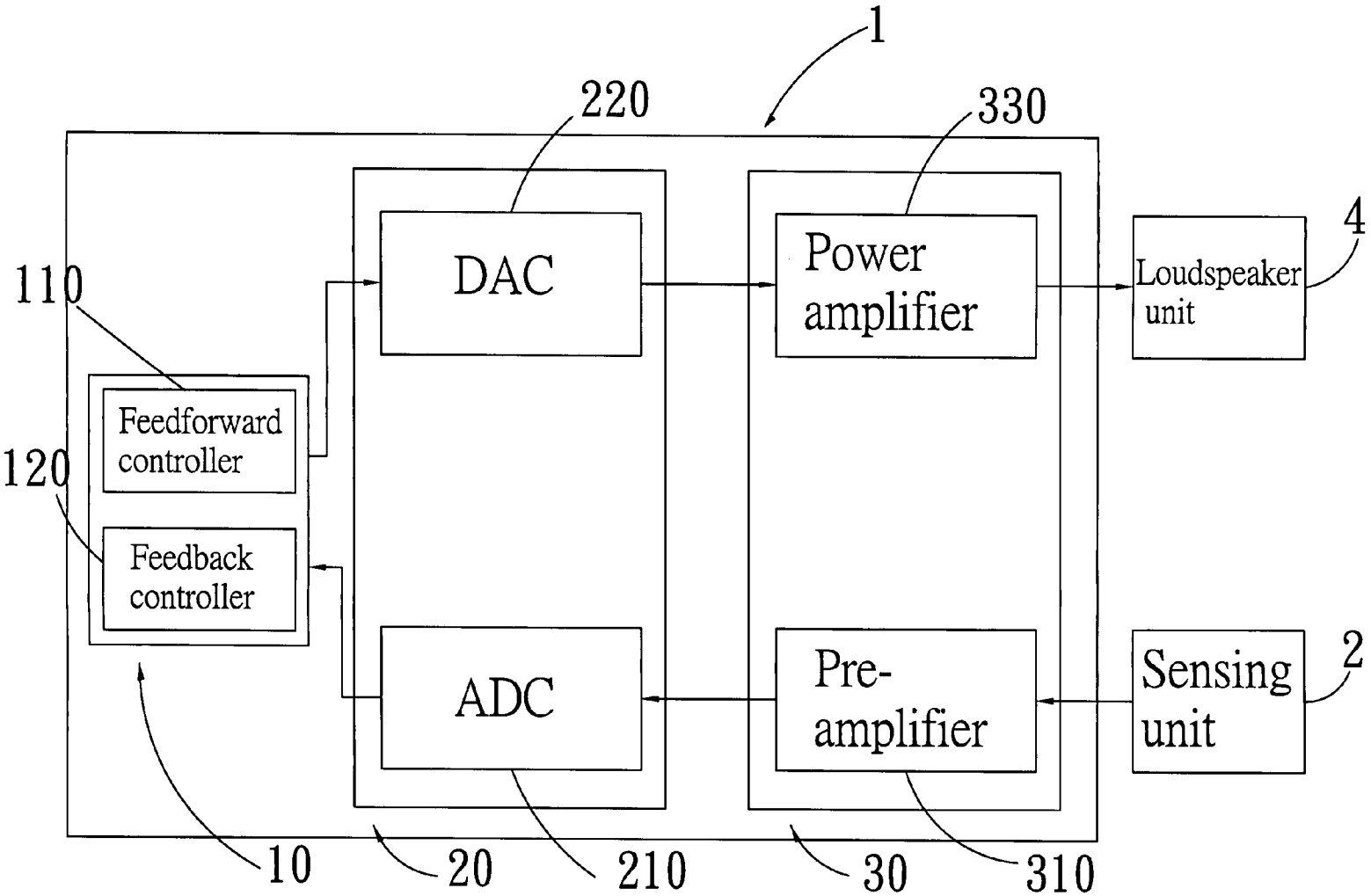
FIG. 2 is a block diagram of the present invention.

Please refer to FIGS. 1 and 2. The communication machine room wideband noise suppression system of the present invention includes a digital signal microprocessor 1, a sensing unit 2, and a loudspeaker unit 4. The sensing unit 2 includes four error microphones 20 and two reference microphones 21. Each of the four error microphones 20 may detect a feedback signal that feeds back an error, and each of the reference microphones 21 may retrieve a noise source produced by a fan 51 during the operation thereof and convert the noise source into a noise input signal. The loudspeaker unit 4 includes four speakers 40.

The digital signal microprocessor 1 includes a multi-channel hybrid controller 10, a signal converting unit 20, and a signal amplifying unit 30. The signal amplifying unit 30 amplifies the noise input signals received from the reference microphones 21 and the feedback signals received from the error microphones 20. The amplified signals are then sent to the signal converting unit 20, at where the signals are converted into digital signals. The multi-channel hybrid controller 10 makes corrections according to the digital signals received from the signal converting unit 20, and conducts rapid convergence algorithm to derive a reverse digital signal, which is then sent by the multi-channel hybrid controller 10 back to the signal converting unit 20 and converted into a reverse analog signal. The reverse analog signal is then sent to the signal amplifying unit 30 for power amplification to generate a control signal. The speakers 40 are driven by the control signal to produce an interfering acoustic wave, so as to cancel out the noise source and thereby achieve the purpose of eliminating wideband noise.

In the preferred embodiment, the signal amplifying unit 30 consists of a pre-amplifier 310 and a second or power amplifier 330. The pre-amplifier 310 has an anti-noise characteristic and is electrically connected to the error microphones 20 and the reference microphones 21 for amplifying the noise input signals and the feedback signals received from the reference microphones 21 and the error microphones 20, respectively. The power amplifier 330 is electrically connected to the speakers 40, and amplifies the power of a received reverse analog signal.

The signal converting unit 20 consists of an analog to digital converter (ADC) 210 and a digital to analog converter (DAC) 220. The ADC 210 receives the signals amplified by the pre-amplifier 310 and converts the received signals into digital signals, and is electrically connected to the pre-amplifier 310 and the multi-channel hybrid controller 10; and, the DAC 220 receives a reverse digital signal from the multi-channel hybrid controller 10 and converts the received reverse digital signal into a reverse analog signal, and is electrically connected to the power amplifier 330 and the hybrid controller 10.

Figure 3:
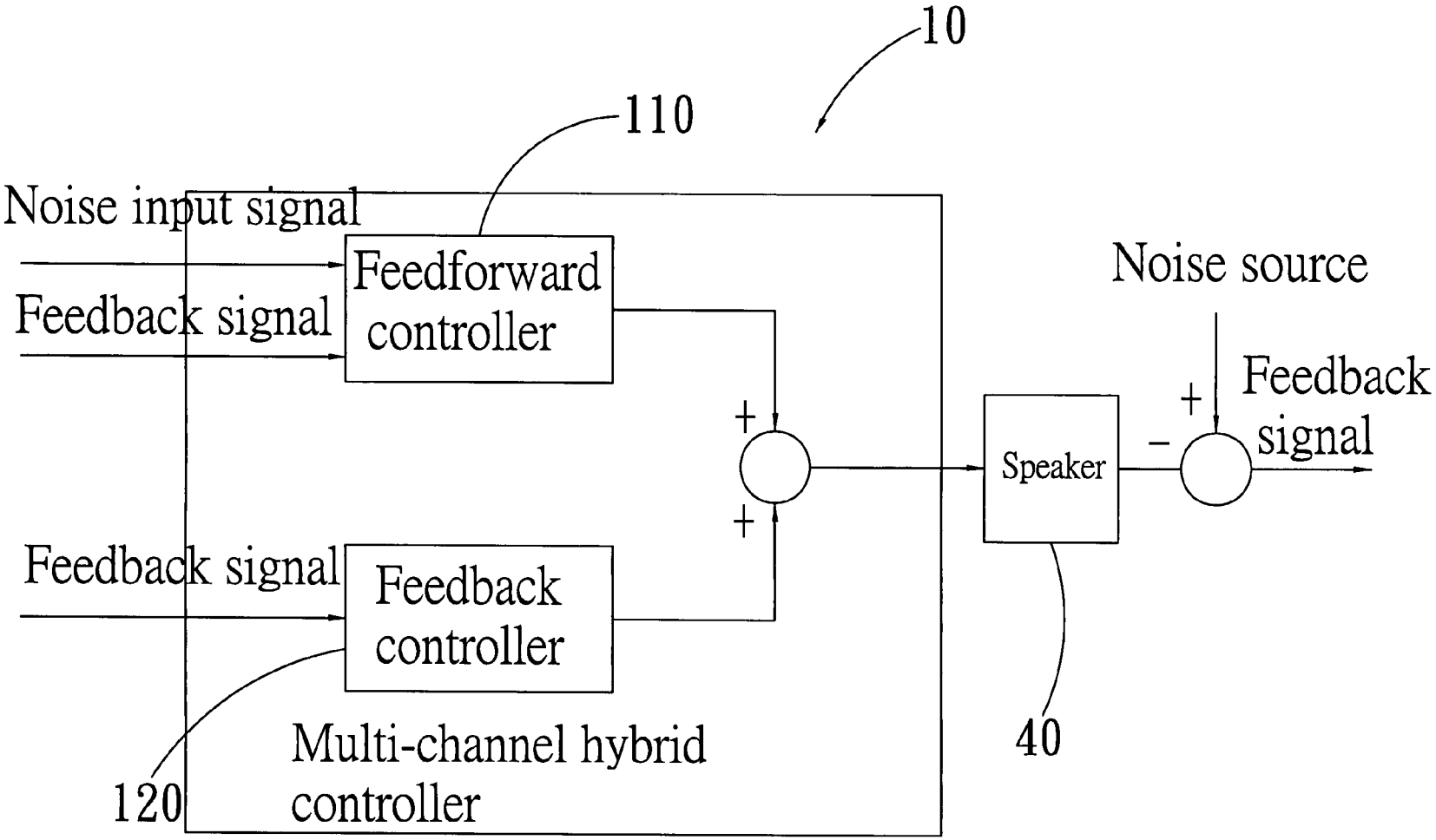
FIG. 3 is an equivalent block diagram of a multi-channel hybrid controller for the present invention.

Please refer to FIGS. 1, 2, and 3. The multi-channel hybrid controller 10 consists of a feedforward controller 110 and a feedback controller 120. The feedforward controller 110 is characterized by its good performance and stability, and the feedback controller 120 is characterized by its rapid convergence algorithm ability.

In the communication machine room, there are provided with two communication machine chassis 5. Each of the two communication machine chassis 5 has one reference microphone 21 provided at one side thereof, and two error microphones 20 and two speakers 40 provided at the other side thereof opposite to the reference microphone 21.

When the fan 51 in each of the two communication machine chassis 5 operates, the corresponding reference microphone 21 retrieves the noise source produced by the fan 51 and converts the noise source into a noise input signal. The noise input signal generated by the reference microphone 21 and the feedback signals detected by the corresponding error microphones 20 are sent to the pre-amplifier 310 at the same time for signal amplification. The amplified signals are then sent to the ADC 210, which converts the received signals into digital signals and sends the digital signals to the multi-channel hybrid controller 10. Then, the feedforward controller 110 calculates based on the received digitalized feedback signals and noise input signal to derive a first reverse digital signal. Meanwhile, the feedback controller 120 also corrects the received digitalized feedback signals and conducts rapid convergence algorithm to derive a second reverse digital signal. The multi-channel hybrid controller 10 adds the first and the second reverse digital signal, and sends the added signal to the DAC 220, at where the added signal is converted into a reverse analog signal. The reverse analog signal is then sent to the power amplifier 330 for power amplification to generate a control signal for driving the corresponding speakers 40 to produce an acoustic wave, which has a level the same as that of the noise source but a phase reverse to that of the noise source to enable the superposition of the acoustic wave and the noise wave as well as the destructive interference of noise source, so as to achieve the purpose of eliminating wideband noise produced by fans of different specifications.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A communication machine room wideband noise suppression system for applying in a communication machine room, comprising:

a loudspeaker unit;

a sensing unit consisting of at least one error microphone and at least one reference microphone; and a digital signal microprocessor consisting of:

a signal amplifying unit consisting of a pre-amplifier and a power amplifier; the pre-amplifier being electrically connected to the error microphone and the reference microphone, and the power amplifier being electrically connected to the loudspeaker unit;

a signal converting unit consisting of an analog to digital converter (ADC) and a digital to analog converter (DAC); the ADC being electrically connected to the pre-amplifier, and the DAC being electrically connected to the power amplifier; and a multi-channel hybrid controller being electrically connected to the ADC and the DAC;

whereby when a fan in the communication machine room operates and produces a noise source, the reference microphone retrieves the noise from the noise source and converts the noise into a noise input signal, which along with a feedback signal detected by the error microphone are sent to the pre-amplifier for signal amplification, and the amplified signals are sent to the ADC and converted into digital signals; and the multi-channel hybrid controller makes corrections based on the digital signals received from the ADC and employs a rapid convergence algorithm to derive a reverse digital signal, which is then sent to the DAC and converted into a reverse analog signal; the reverse analog signal is then sent to the power amplifier for power amplification to generate a control signal; and the loudspeaker unit is driven by the control signal to produce an interfering acoustic wave to cancel out the noise source to achieve the purpose of eliminating the wideband noise source.

2. The communication machine room wideband noise suppression system as claimed in claim 1, wherein the multi-channel hybrid controller consists of a feedforward controller and a feedback controller.

3. The communication machine room wideband noise suppression system as claimed in claim 1, wherein the loudspeaker unit includes at least one speaker.

4. The communication machine room wideband noise suppression system as claimed in claim 1, wherein the system is a standalone system.

* * * * *